US005097765A

United States Patent [19]

Ziemba

[11] Patent Number: 5,097,765

[45] Date of Patent: Mar. 24, 1992

[54] ELECTRIC FUZE WITH SELECTABLE MODES

[75] Inventor: Richard Ziemba, Burlington, Vt.

[73] Assignee: The United States of America as represented by the Secretary of the Army, Washington, D.C.

[21] Appl. No.: 676,610

[22] Filed: Mar. 28, 1991

[51] Int. Cl.[5] ..... F23Q 7/02

[52] U.S. Cl. ..... 102/218; 102/215; 102/216; 102/472; 102/703; 89/6.5

[58] Field of Search ..... 102/206, 472, 215, 218, 102/703, 200, 216; 89/6, 6.5

[56] References Cited

U.S. PATENT DOCUMENTS 3,334,588 8/1967 Larsen ..... 102/703
3,500,746 3/1970 Ambrosini ..... 102/215
3,814,017 6/1974 Backstein et al. ..... 89/6.5
4,015,531 4/1977 Ziemba ..... 102/206

FOREIGN PATENT DOCUMENTS 729372 5/1955 United Kingdom ..... 102/472
929075 6/1963 United Kingdom ..... 102/472

*Primary Examiner*—Stephen Johnson
*Attorney, Agent, or Firm*—Anthony T. Lane; Edward Goldberg; Michael C. Sachs

[57] ABSTRACT

A base mounted remote set digital time fuze permits a chambered round to have power, time setting information and cartridge case firing voltage available at an electric primer terminal of the cartridge case. Fuze power, time setting information and cartridge firing are performed sequentially over the same hardwire line.

2 Claims, 2 Drawing Sheets

ELECTRIC FUZE WITH SELECTABLE MODES

GOVERNMENTAL INTEREST

The invention described herein was made in the course of Government Contract DAAA09-76-C-2055 and may be manufactured, used and licensed by or for the Government for Governmental purposes without the payment to me of any royalties thereon.

BACKGROUND OF THE INVENTION

Modern weapon system development has improved the range, accuracy, rapidity of fire, and lethality of guns and ammunition under a variety of battlefield conditions. The general improvement in weapon lethality supplied to ground troops has made it extremely important for personnel in armored vehicles to spot the enemy and fire an air burst before being fired upon. The amount of time that an armored vehicle commander has to make a decision and see that a fire command is executed can be very short. To overcome or shorten these lift threatening time constraints, personnel in armored vehicles, such as tanks, frequently travel with a round chambered in its gun. The problem with these chambered prior art rounds was that the range is preset and cannot be quickly changed without unchambering the round. Thus an armored vehicle traveling with a chambered round may be at a severe disadvantage, when an air burst is desired, if the preset fuze range is incorrect.

SUMMARY OF THE INVENTION

The present invention relates to a projectile which is fully telescoped into its cartridge case and has a fuze which may be remotely set after it is chambered in a gun. A communication link is provided via a hardwire through the cartridge case primer to a digital time fuze located in the base of the projectile body.

An object of the present invention is to provide a hardwire remote set digital time fuze for which no internal fuze power generator is required.

Another object of the present invention is to provide for a digital time fuze which is powered and set only after the round is chambered and the breech of the gun is sealed.

Another object of the present invention is to provide a hardwire remote set digital time fuze which requires no modification to the weapon to accommodate the fuze setting technique.

Another object of the present invention is to provide a hardwire remote set digital time fuze which has a low cost design.

A further object of the present invention is to provide a hardwire remote set digital time fuze which has high system reliability due to the limited number of parts required in the design.

For a better understanding of the present invention, together with other and further objects thereof, reference is made to the following descriptions taken in connection with the accompanying drawings.

BRIEF DESCRIPTION OF THE DRAWINGS

Throughout the following description, like reference numerals are used to denote like parts of the drawings.

DETAILED DESCRIPTION OF THE PREFERRED EMBODIMENTS

Figure 1:
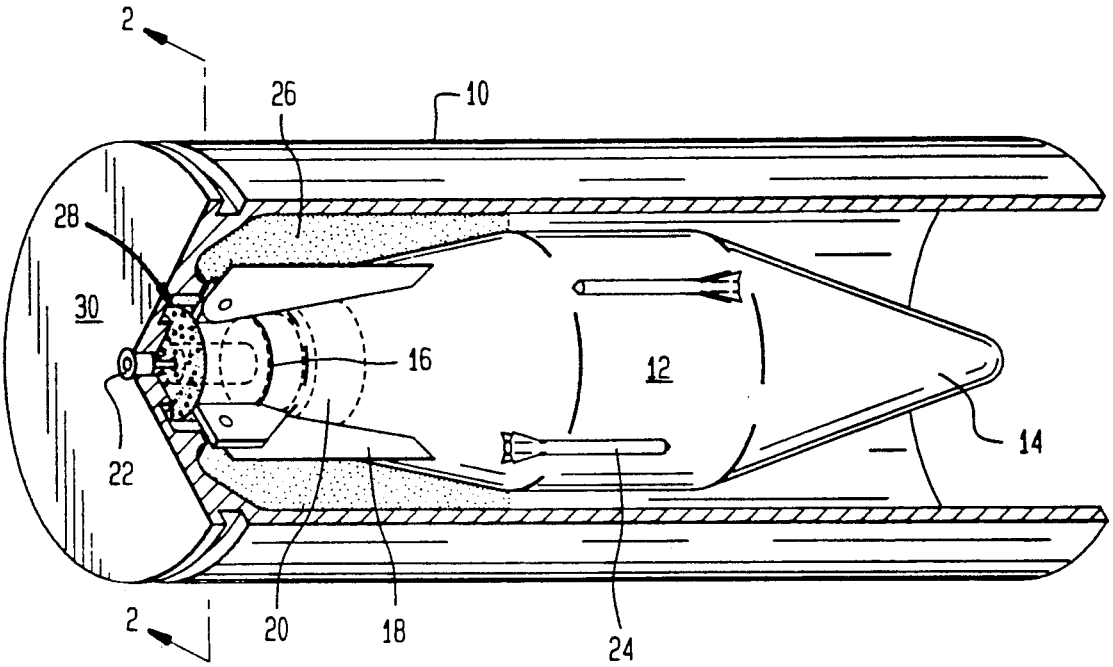
FIG. 1 is a cutaway isometric view of a telescoped round positioned in a cartridge case.

Referring now to FIG. 1, a cartridge case 10 has a telescoped round 12 axially supported therein. The front end of round 12 has a dummy nose cover 14. The rear end 16 of round 12 operatively supports fin assembly 18 and includes the base fuze 20 which is electrically and mechanically coupled to the cartridge primer 22. The round warhead in this particular instance diagrammatically shows flechette type charge 24 for illustrative purpose of what may be used in an air burst round. A propellant charge 26 is operatively disposed between round rear end 16 and the cartridge case 10. A black powder charge 28 is operatively axially positioned in the cartridge case rear end 30 between the primer 22 and the round rear end 16.

Figure 2:
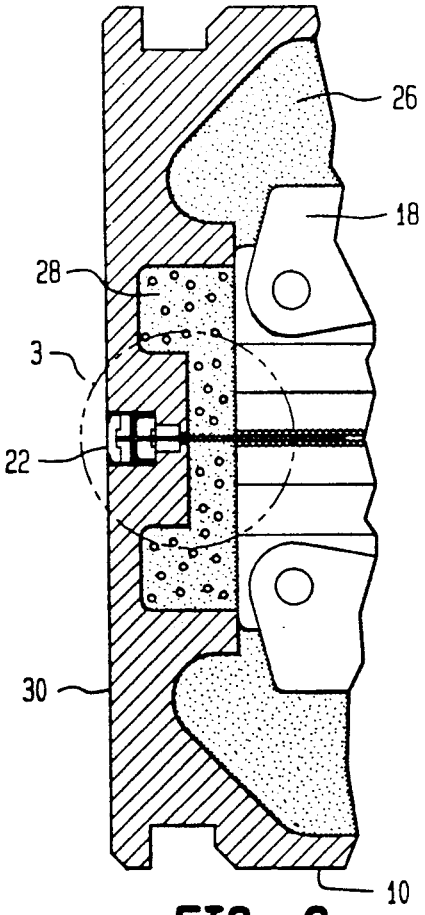
FIG. 2 is a partial enlarged cross sectional view of the primer-to-fuze hardwire link mechanization taken along line 2—2 of FIG. 1.
Figure 3:
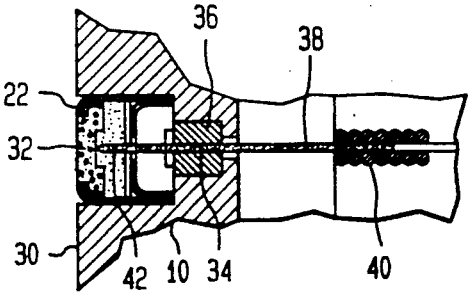
FIG. 3 is a further enlarged partial cross sectional view of the primer-to-fuze hardwire link mechanism taken from within circle line 3 of FIG. 2.

Referring now to FIGS. 2 and 3 the electric primer terminal 22 has an electrically initiated pyrotechnic charge 32 therein which is used to ignite the black powder charge 28 which in turn initiates the propellant charge 26. A primer-to-fuze hardwire link is comprised of a contact pin 34 which is electrically isolated from the cartridge case 10 by an insulator 36. The forward end 28 of contact pin 34 makes electrical contact with the base fuze 20 through helical contact spring 40 and the rear end 42 of contact pin 34 makes electrical contact with a primer firing voltage source, not shown, through pyrotechnic charge 32.

Figure 4:
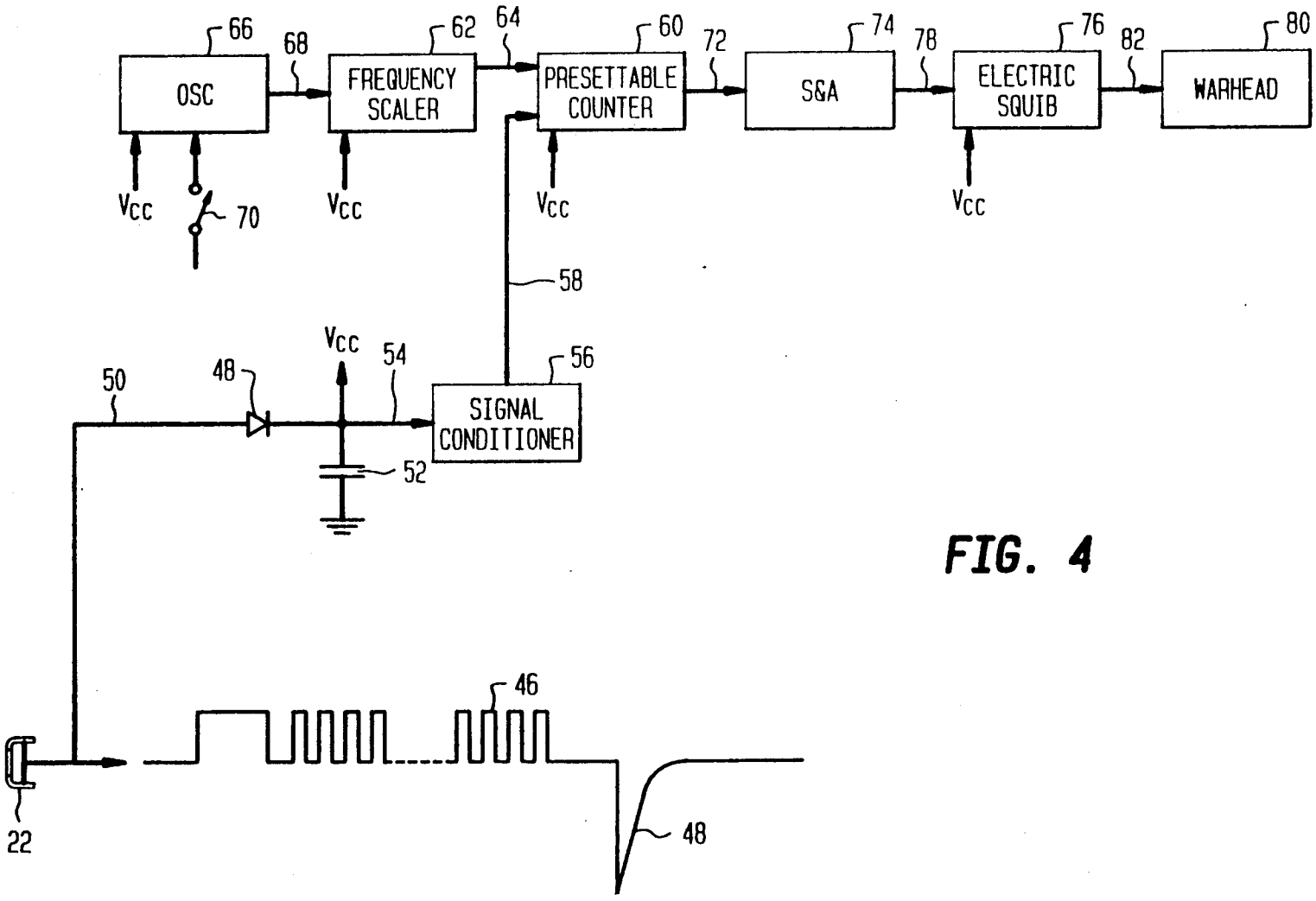
FIG. 4 is a functional schematic diagram of the hardwire remote set digital time base fuze.

Referring now to the functional schematic electrical diagram and waveform of FIG. 4, once the round shown in FIG. 1 is chambered, a fire control system determines target range, via a laser range finder, and computes time-of-flight of the round 12 based upon the known exterior ballistics of that round. Fire control converts this information into a data train consisting of a finite number of +15 volt pulses 46 and a −160 volt firing signal 48.

In operation, these +15 volt pulses are applied to the primer 22 and carried via the hardwire data link of FIGS. 3 and 4 to the fuze circuitry within the round 12. All of the elements forward of the primer 22 are considered part of the projectile fuze. The +15 volt pulse signals are fed to a blocking diode 48 via an electrical conductor 50 which is connected to the primer 22 through helical spring 40 and contact pin 38. Diode 48 allows the +15 volt signal from the primer 22 to pass and charge capacitor 52 but blocks the −160 volt signal. This prevents the −160 volt signal from discharging capacitor 52. Once the storage capacitor is charged to voltage Vcc it supplies power to the electronics as indicated by the arrows marked Vcc. The data pulse train is fed via electrical conductor 54 to the input of signal conditioner 56. The signal conditioner 56 is used to condition the pulse train coming from the primer 22 so as to be properly inputted via conductor 58 to a presettable counter 60. The number of pulses fed into the counter 60 from the signal generator 56 is always less than a full count. The difference is made up from the frequency scaler 62 input via input conductor 64 once the round 12 is in flight. An oscillator 66 which serves as a time base for the fuze 20 has its output via electrical conductor 68 to the frequency scaler 62 inhibited until a set back switch 70 is enabled at the first motion of the projectile 12. Projectile motion is initiated when fire control applies a −160 volt firing signal to the primer 22. From that point on, the counter 60 which has a capacity of about 8,000 counts, for an 8 second time-of-flight, is driven from the scaler 62. When the counter 60 is filled, it produces an output via conductor 72 through a safing and arming system 74 to an electric squib 76 via electrical conductor 78. The safe and arming 74 is a mechanical system which aligns an explosive train, not shown, to an armed state once the necessary gun launch environmental conditions have been properly sensed. The electric squib 76 then initiates the warhead 80 via electrical conductor 82.

While a specific embodiment of the invention has been shown and described in detail to illustrate the application of the principles of the invention, it will be understood that the invention may be embodied otherwise without departing from such principles.

What is claimed is:

1. A hardwire remote set digital time fuze which comprises:

a cartridge case;

a telescoped round operatively positioned in said cartridge case;

a propellant charge positioned in said cartridge case intermediate said cartridge case and said round;

a black powder charge operatively disposed in said cartridge case intermediate between said cartridge case and said propellant charge;

base fuze means operatively disposed in said round for remotely time setting the range of said round after said cartridge case is chambered; and an electrically conductive primer means operatively disposed in said cartridge case providing an electrical circuit path for executing base fuze firing commands over a slidable primer contact pin means, said pin means electrically connected at one end to said base fuze means, and at the pin means other end to a pyrotechnic charge in said primer means for enabling power to pass through and ignite said pyrotechnic charge by way of an electric primer terminal in said primer means;

an insulator operatively supported in said cartridge case for insulating said contact pin means from said cartridge case;

contact means for making sliding contact with said contact pin means;

diode means electrically connected to said contact pin means for allowing a +15 volt signal from said primer terminal to pass therethrough;

capacitor means electrically connected from the output of said diode means to ground for storing positive charge from said primer means, said diode means preventing a −160 volt fire signal from discharging said capacitor means, and for powering said base fuze electronic circuitry;

a signal conditioner electrically connected to the output terminal of said diode means for conditioning pulse trains coming from said primer means;

a presettable counter having dual input terminals, a first input terminal electrically coupled to the output of said signal conditioner;

a frequency scaler having an output electrically connected to a second input of said presettable counter;

an oscillator having an output electrically connected to the input of said frequency scaler, said oscillator providing a time base for said fuze means;

high gravity switch means for allowing said oscillator to run only after said round is fired, said switch means changing from a normally open position to a normally closed position as a result of set back;

safe and arms means for placing said round in an armed state once the necessary gun launch environmental conditions have been properly sensed; and electric squib means electrically coupled to said presettable counter through said safe and arm means for electrically initiating the warhead of said round when the round has reached its intended target area.

2. A hardwire remote set digital time fuze as recited in claim 1 wherein said contact means includes a helical spring.

* * * * *